United States Patent [19]

Amano

[11] 4,132,139

[45] Jan. 2, 1979

[54] RHYTHM SELECTION SWITCH ASSEMBLY FOR ELECTRONIC MUSICAL INSTRUMENTS

[75] Inventor: Takehisa Amano, Hamamatsu, Japan

[73] Assignee: Nippon Gakki Seizo Kabushiki Kaisha, Shizuoka, Japan

[21] Appl. No.: 785,826

[22] Filed: Apr. 8, 1977

[30] Foreign Application Priority Data

Apr. 10, 1976 [JP] Japan ..... 51-44984[U]

[51] Int. Cl.[2] ..... G10H 1/00; G10H 5/00

[52] U.S. Cl. ..... 84/1.03; 84/1.17; 84/DIG. 12

[58] Field of Search ..... 84/1.03, DIG. 12, 1.01, 84/1.17, DIG. 7

[56] References Cited

U.S. PATENT DOCUMENTS

| | | | |
|---|---|---|---|
| Re. 28,999 | 10/1976 | Southard | 84/1.03 |
| 3,118,961 | 1/1964 | Peterson | 84/1.17 |
| 3,207,835 | 9/1965 | Holman et al. | 84/1.03 |
| 3,461,217 | 8/1969 | Omura et al. | 84/1.03 X |
| 3,519,722 | 7/1970 | Heytown | 84/1.17 |
| 3,757,024 | 9/1973 | Stinson Jr. et al. | 84/1.17 |
| 3,829,597 | 8/1974 | Peterson et al. | 84/1.03 |
| 3,962,945 | 6/1976 | Creager et al. | 84/DIG. 12 |

*Primary Examiner*—Stanley J. Witkowski
*Attorney, Agent, or Firm*—Flynn & Frishauf

[57] ABSTRACT

A rhythm selection switch arrangement mounted on the operation panel of an electronic musical instrument. The switch arrangement comprises a plurality of on-off push changeover switches arranged successively and a changeover push switch disposed adjacent to the two-position push switch nearest to the player of the electronic musical instrument. The two-position push switches are to select a rhythm, and the push switch is to control the standard or variation mode of the selected rhythm.

3 Claims, 4 Drawing Figures

RHYTHM SELECTION SWITCH ASSEMBLY FOR ELECTRONIC MUSICAL INSTRUMENTS

BACKGROUND OF THE INVENTION

This invention relates to a rhythm selection control device for an electronic musical instrument.

Generally an automatic rhythm playing apparatus is built into an electronic musical instrument. To select a rhythm and a mode of the selected rhythm a switch assembly is arranged on the operation panel of the electronic musical instrument. The conventional rhythm selection control device has a switch unit constituted by a plurality of three-position push switches, the number of which is equal to the number of rhythms which can be played by the automatic rhythm playing apparatus. While all the three-position push switches remain at their top position, no rhythm is played. When any one of push switches is pushed to an intermediate position, a corresponding rhythm is selected and played in the standard mode. When the push switch is further pushed to its bottom position, the rhythm playing is switched to the variation mode. If the push switch at its bottom position is tapped lightly, it returns to its intermediate position. Further, the push switch, locked at its intermediate or bottom position, returns to its top position when any other push switch at its top position is tapped lightly.

As mentioned above, in the conventional rhythm selection control device the mode of a rhythm is controlled in accordance with the depth at which the push switch is locked. A selected rhythm is switched from the standard mode to the variation mode when the corresponding three-position push switch is pushed from its intermediate position to its bottom position. Such a switch locking cannot always correctly be made since it is difficult for a player to exactly push the switch to the specified depth while playing the electronic musical instrument. The player may push the push switch mistakenly too shallow or too deep. As a result, the selected rhythm is played in the variation mode when the player wants to have the rhythm played in the standard mode. Conversely, the selected rhythm is played in the standard mode when the player wants to have the rhythm played in the variation mode.

SUMMARY OF THE INVENTION

The object of this invention is to provide a rhythm selection switch arrangement which permits an easy and correct switching between the standard mode and variation mode of a selected rhythm.

The rhythm selection switch device according to the present invention comprises a plurality of two-position push switches successively arranged for selecting a rhythm among many rhythms, and a changeover push switch disposed adjacent to the two-position push switches so as to be nearest to the player for controlling the standard or variation mode of the selected rhythm.

DETAILED DESCRIPTION OF THE PREFERRED EMBODIMENT

Figure 1:
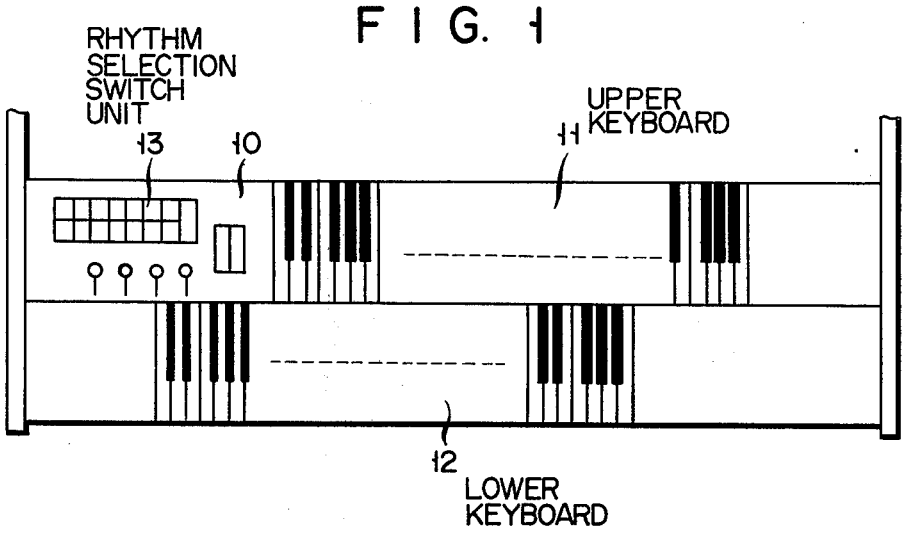
FIG. 1 is an upper plan view of an electronic musical instrument which is provided with a rhythm selection switch arrangement according to this invention.

The electronic musical instrument shown in FIG. 1 is provided with an upper keyboard 11 for melody performance and a lower keyboard 12 for accompaniment performance. On the operation panel 10 on the left side of the upper keyboard 11 there is arranged a rhythm selection switch arrangement 13 according to this invention.

Figure 2:
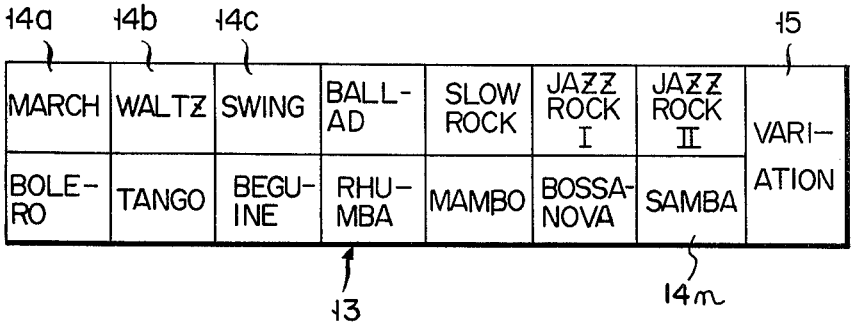
FIG. 2 is an upper plan view of the rhythm selection switch arrangement shown in FIG. 1.

As shown in FIG. 2, the rhythm selection switch arrangement 13 comprises a plurality of push-type rhythm selection switches **14*a*, 14*b*, 14*c*, . . . 14*n* and a variation-standard mode control switch 15. The rhythm selection switches 14*a* to 14*n* are arranged in two rows and correspond to different rhythms. The variation-standard mode control switch 15 is disposed at the right end of the two rows of rhythm selection switches, i.e., at the nearest position to the player or at the nearest position to a central part of one of the keyboards, and the upper operating portion of switch 15 is made larger than the other push switches so as to be easily distinguished therefrom. It serves to control the mode of each rhythm. In this embodiment the length of the side of the mode control switch 15 which is adjacent to the two rows of the rhythm selection switches 14*a*, 14*b*, 14*c*, . . . 14*n* is substantially equal to the whole length of the sides of the two rhythm selection switches adjacent to the mode control switch 15 as shown in FIG. 2. If not so many rhythm selection switches are provided, they may be arranged in a single row. In such a case, the variation-standard mode control switch 15 may be made to have the same size as the push switches 14*a* to 14*n***.

Each of the rhythm selection switches **14*a* to 14*n* is a two-position push switch. As long as it remains at the top or "out" position, the corresponding rhythm is not played. When it is pushed to its bottom or "in" position, the corresponding rhythm is selected. The selected rhythm is played when the rhythm selection switch is locked at its bottom position. Similarly, the variation-standard mode control switch 15 is constituted by a two-position push switch. While it stays at its top or "out" position, a selected rhythm, if any, is played in a standard mode. If the control switch 15 is pushed to its bottom or "in" position, the standard mode is switched to a variation mode where the same kind of rhythm as in the standard mode is automatically performed with a predetermined variation. Then the selected rhythm is played in the variation mode so long as the control switch 15** is locked at its bottom position.

The variation-standard mode control switch 15, which commonly serves all the rhythms that can be played, is provided separately from the rhythm selection switches **14*a* to 14*n*. Further it is arranged in the switch unit at the nearest position to the player. For this reason, the player can operate the control switch 15 quite easily to effect a switching between the standard mode and variation mode, even while playing the electronic musical instrument. The control switch 15 may be more easily operated, if its upper operating portion is made larger in size than the rhythm selection switches 14*a* to 14*n*** as shown in FIG. 2.

Figure 3:
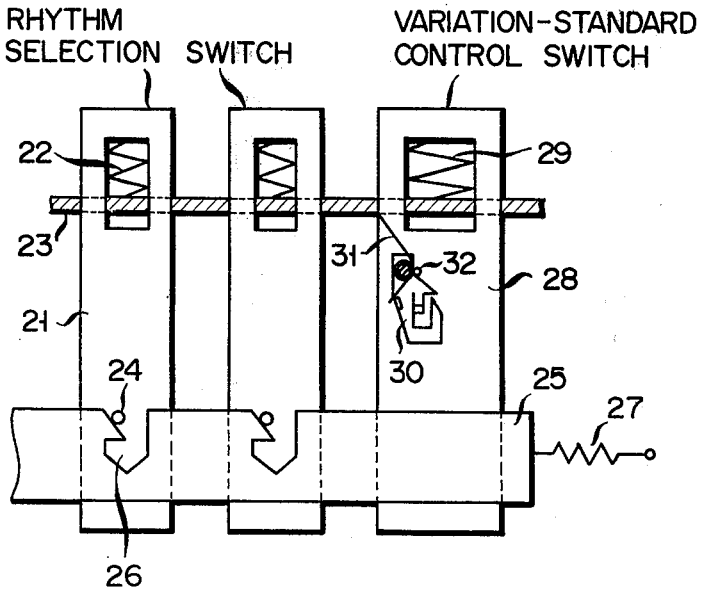
FIG. 3 shows schematically an example of the construction of the rhythm selection switch arrangement according to this invention.

The rhythm selection switches 14*a* to 14*n* and the variation-standard mode control switch 15 may be constructed as shown schematically in FIG. 3. Each rhythm selection switch includes a movable plate 21 and a spring 22. The movable plate 21 is urged upwards by the spring 22 and protrudes from the panel 23. A pin 24 is fixed to the lower portion of the movable plate 21. An engaging plate 25 extends horizontally and closely to the lower portions of the movable plates 21. The plate 25 has a plurality of notches 26, the number of which equals that of the movable plates 21 of the rhythm selection switches. Plate 25 is urged to the right by a spring 27. When any movable plate 21 is depressed, its pin 24 comes into engagement with the corresponding notch 26 of the plate 25. Thereafter the movable plate 21 is kept locked at its bottom position. When any other movable plate is depressed, its pin so acts as to move the plate 25 to the left against the spring 27. At this moment the pin 24 of the movable plate 21 is disengaged from the notch 26, and the movable plate 21 returns to top position.

The variation-standard mode control switch 15 is provided with a movable plate 28, a spring 29, a hysteresis cam 30, a spring 31 and a pin 32. The movable plate 28 is urged upwards by the spring 29.

The hysteresis cam 30 is attached to a frame member (not shown) and urged by the spring 31 so as to be rockable in two directions perpendicular to each other in accordance with the movement of the pin 32. When the movable plate 28 is depressed from the top position, the pin 32 comes into engagement with the cam 30, thereby to lock the movable plate 28 at its bottom position. When the movable plate 28 is depressed from its locked bottom position, the pin 32 is disengaged from the cam 30, to thereby permit the movable plate 28 to return to its top position.

Top surfaces of the respective movable plates 21 and 28 are preferably covered by ornamental plates or buttons as shown in FIG. 2.

Figure 4:
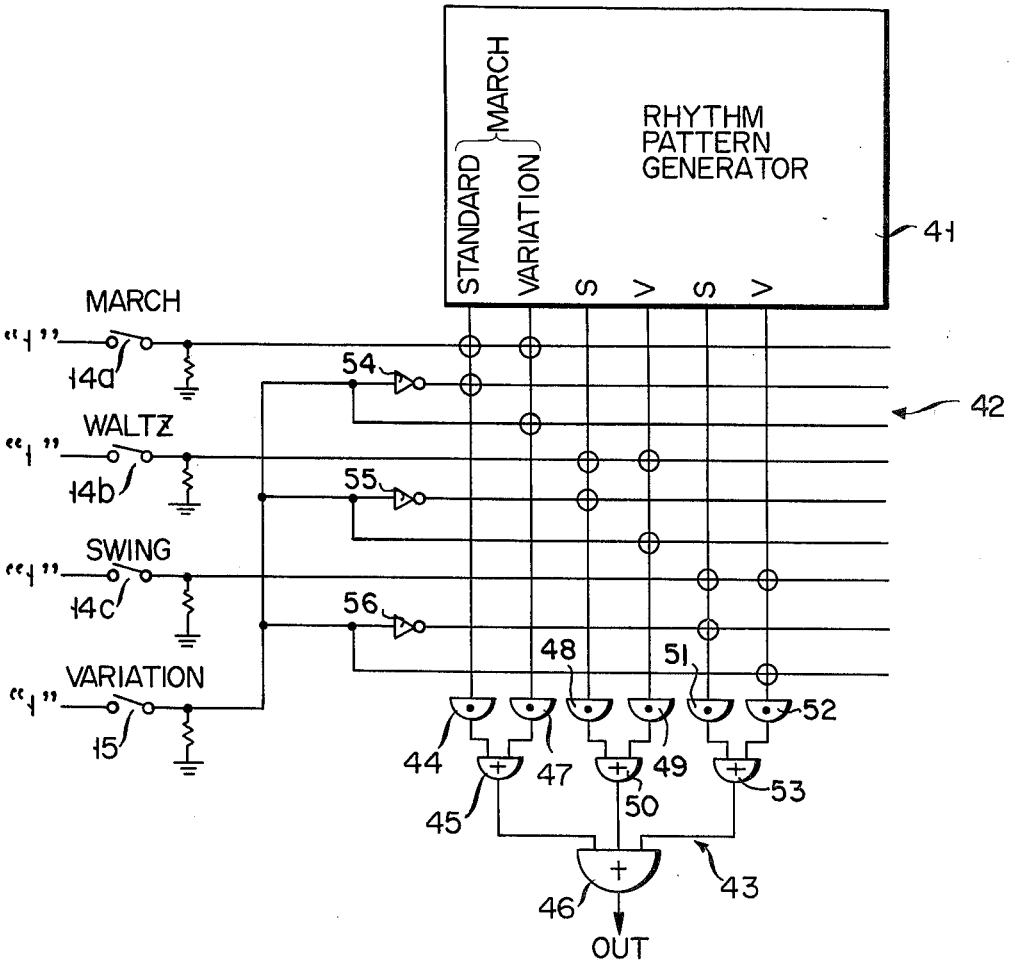
FIG. 4 shows an example of an automatic rhythm playing apparatus to be used in combination with the rhythm selection arrangement according to this invention.

FIG. 4 shows an automatic rhythm playing apparatus in combination with the rhythm selection switch assembly of this invention. The apparatus is chiefly comprised of a rhythm pattern generator 41 and a matrix circuit 42. The rhythm pattern generator 41 has a standard mode output and a variation mode output of each rhythm and is connected to the matrix circuit 42. The matrix circuit 42 receives a logical 1-level signal when any one of the rhythm selection switches 14*a* to 14*n* is pushed to select the corresponding rhythm. It receives a logical 0-level signal if no rhythm is selected.

In addition, the matrix circuit 42 receives a logical 1-level signal when the variation-standard mode control switch 15 is pushed to its bottom position and a logical 0-level signal while the control switch 15 remains at its top position.

The matrix circuit 42 is connected to a logic circuit 43. These circuits 42 and 43 cooperate to select one of the rhythm pattern signals generated by the rhythm pattern generator 41. For example, march rhythm is selected in the following manner. When the switch 14*a* is closed while the variation-standard mode control switch 15 is open, an AND gate 44 of the logic circuit 43 is enabled. As a result, a standard mode output of march rhythm is taken out through OR gates 45 and 46 of the logic circuit 43. To switch the standard mode of march to the variation mode, the variation-standard mode control switch 15 is closed. When the control switch 15 is closed, an AND gate 47 of the logic circuit 43 is enabled. Consequently, a variation mode output of march is taken out through the OR gates 45 and 46. Similarly, AND gates 48, 49 and OR gate 50 operate during performance of waltz rhythm and AND gates 51, 52 and OR gate 53 operate during performance of swing rhythm, as should be apparent from FIG. 4. Inverters 54–56 coupling mode control switch 15 to the matrix circuit 42 operate, as is conventional, to provide respective "1" signals to the AND gates 44, 48, 51 when the mode control switch 15 is in its open or inoperative state.

What is claimed is:

1. An electronic musical instrument comprising:

at least one keyboard;

means coupled to said at least one keyboard for producing musical sounds;

an operation panel located adjacent to said at least one keyboard;

an automatic rhythm generating means; and a rhythm selection switch means coupled to said automatic rhythm generating means and arranged on the operation panel for selecting a rhythm and contolling a standard or variation mode of the selected rhythm;

said rhythm selection switch means comprising:

a plurality of first switches each of which is a push-type switch, said first switches being coupled to said rhythm generating means for selecting a respective rhythm, said first switches being arranged in two adjacent rows, one above the other; and one second push-type switch for selecting one of the standard and variation mode of the selected rhythm, said second switch being disposed adjacent to the endmost first switches of each of said two rows so as to be nearest to the player, the operating portion of said second switch being larger in size than that of said first switches and the length of the side of said second switch which is adjacent said endmost switches of the two rows of said first switches being substantially equal to the sum of the lengths of the sides of the two first switches adjacent to said second switch.

2. The electronic musical instrument of claim 1 comprising a lower accompaniment keyboard and an upper melody keyboard, said operation panel being located adjacent to said upper accompaniment keyboard.

3. The electronic musical instrument of claim 1, wherein said first switches are coupled together such that operation of one of said first switches causes release of a previously operated first switch.

* * * * *